United States Patent [19]

Blix et al.

[11] 4,409,898

[45] Oct. 18, 1983

[54] ELECTRIC IGNITER

[75] Inventors: Jan-Olov Blix, Kristinehamn; Sven-Erik Bratt; Olof Nygårds, both of Karlskoga, all of Sweden

[73] Assignee: Aktiebolaget Bofors, Bofors, Sweden

[21] Appl. No.: 260,632

[22] Filed: May 5, 1981

[30] Foreign Application Priority Data

May 27, 1980 [SE] Sweden ..... 8003924

[51] Int. Cl.[3] ..... F42C 19/12

[52] U.S. Cl. ..... 102/202.5

[58] Field of Search ..... 102/202.5, 202.8, 202.2, 102/431

[56] References Cited

U.S. PATENT DOCUMENTS 4,335,653 6/1982 Bratt et al. ..... 102/202.8

*Primary Examiner*—Richard E. Schafer
*Assistant Examiner*—Ted L. Parr
*Attorney, Agent, or Firm*—Pollock, Vande Sande & Priddy

[57] ABSTRACT

The present invention relates to an electric igniter of the type which comprises two electrically conducting bodies (8, 9) separated by an electrically insulating body (10). The conductive and insulating bodies define a very smooth common end surface (13) with an interconnecting member (20) for electrically connecting the conductive bodies (8, 9). A pyrotechnic charge (14) is in contact with the interconnecting member (20 ) for ignition when said member is heated by flow of electric current therethrough. The interconnecting member (20) comprises at least one relatively thin metal layer (21, 22) which is bonded to said smooth end surface and a thin inert layer (23) applied directly on the metal layer (22). In addition to said layers the interconnecting member (20) also comprises a metal thin film layer (24) applied directly on the inert layer, the interconnecting member (20) being adjusted to its correct resistance value by means of oxidizing the metal layer (22) adjoining the inert layer (23).

6 Claims, 2 Drawing Figures

ELECTRIC IGNITER

FIELD OF THE INVENTION

The present invention relates to an electric igniter particularly for use with artillery ammunition. The igniter is of the type which comprises two electrically conductive bodies separated by an insulating body, preferably made of glass or a ceramic material, the conductive bodies and said insulating body defining a common end surface on which is disposed a thin member electrically interconnecting the conductive bodies, and a pyrotechnic charge pressed into contact with the interconnecting member and ignitable when the member is heated by a flow of electric current therethrough.

PRIOR ART

In our Swedish Patent Application No. 77.04435-2, and its counterpart, U.S. Pat. No. 4,267,567, an electric igniter of this type is described in which the conductive bodies, the insulating body and the interconnecting member are bonded together to form a mechanically strong construction which is substantially unaffected by temperature variations in the bodies within a predetermined temperature range. The interconnecting member comprises at least one thin metal layer applied directly to the common end surface of the bodies, which surface is made very smooth, and the interconnecting member is dimensioned so that its resistance and hence heat generation can be accurately predetermined. The pyrotechnic charge is preferably in direct contact with the interconnecting member under a comparatively high pressure.

An electric igniter of this type can be used in various kinds of ammunition for electrically detonating the ammunition charge. For example the charge in a projectile can be detonated by an impact contact or similar activating means coupling an electrically charged capacitor to the igniter.

The resistance of the interconnecting member can be adjusted to a predetermined value by forming gaps in specific parts of the metal layers. Such gaps are formed preferably by means of laser cutting methods. Even though these prior laser cutting methods make it possible to determine the resistance value with a very high accuracy, the laser devices required are very complicated and expensive.

In order to increase further the mechanical strength as well as the electrical properties of an electric igniter of the above-mentioned type the interconnecting member can be provided with a thin inert layer (for instance of glass, $Si\,O_2$ or the like) in addition to said metal layers as disclosed in our Swedish application No. 79.07294-8 and its counterpart, U.S. Pat. No. 4,335,653. The thin inert layer is disposed directly on the upper metal layer and the pyrotechnic charge is held in direct contact with the inert layer under a comparatively high pressure. An advantage is that the inert layer protects the metal layers against mechanical damage and improves the connection of the metal layers to the underlying surface. The inert layer further protects the metal layers against corrosion.

OBJECT OF THE INVENTION

One purpose of the present invention is to provide an electric igniter of the above-mentioned kind, i.e. with an inert layer disposed on one or more metal layers, which is more insensitive to interference caused by electromagnetic radiation and static electricity.

Another purpose of the invention is to provide an electric igniter in which it is easier to adjust the resistance of the interconnecting member compared with the above-mentioned laser cutting method.

SUMMARY OF THE INVENTION

According to the present invention the interconnecting member for electrically connecting the conductive bodies of the igniter includes, in addition to said one or more metal layers and inert layer, a metal thin film layer disposed directly upon the inert layer, the resistance of the connective member being adjusted to its correct value by oxidation of at least one of the metal layers which adjoins the inert layer and a surface of said conductive bodies.

The metal thin film layer forms a virtual earth to function as a shield against electromagnetic radiation. Compared with the inert layer, the thin film layer is a good conductor of heat which means that heat generated in the underlying metal layers due to electric interference pulses can more easily be lead away. The thin film layer further makes the electric igniter somewhat "slower" i.e. it increases the safety of the igniter against accidental ignition of the pyrotechnic charge caused by a single electrostatic interference pulse.

The layer whose resistance is adjusted by means of oxidation is preferably made of an easily oxidizable metal, for instance tantalum or aluminium. The metal layer can be oxidized by means of an oxidation method known per se, for instance by oxidation in an oven by means of nitrogen. The degree of oxidation, and consequently the resistance value, depends on the duration of the oxidation process so that it is very simple to attain the desired resistance value for the interconnecting member.

BRIEF DESCRIPTION OF THE DRAWINGS

A preferred embodiment of the present invention will now be described with reference to the accompanying drawings, in which.

DETAILED DESCRIPTION OF PREFERRED EMBODIMENT

Figure 1:
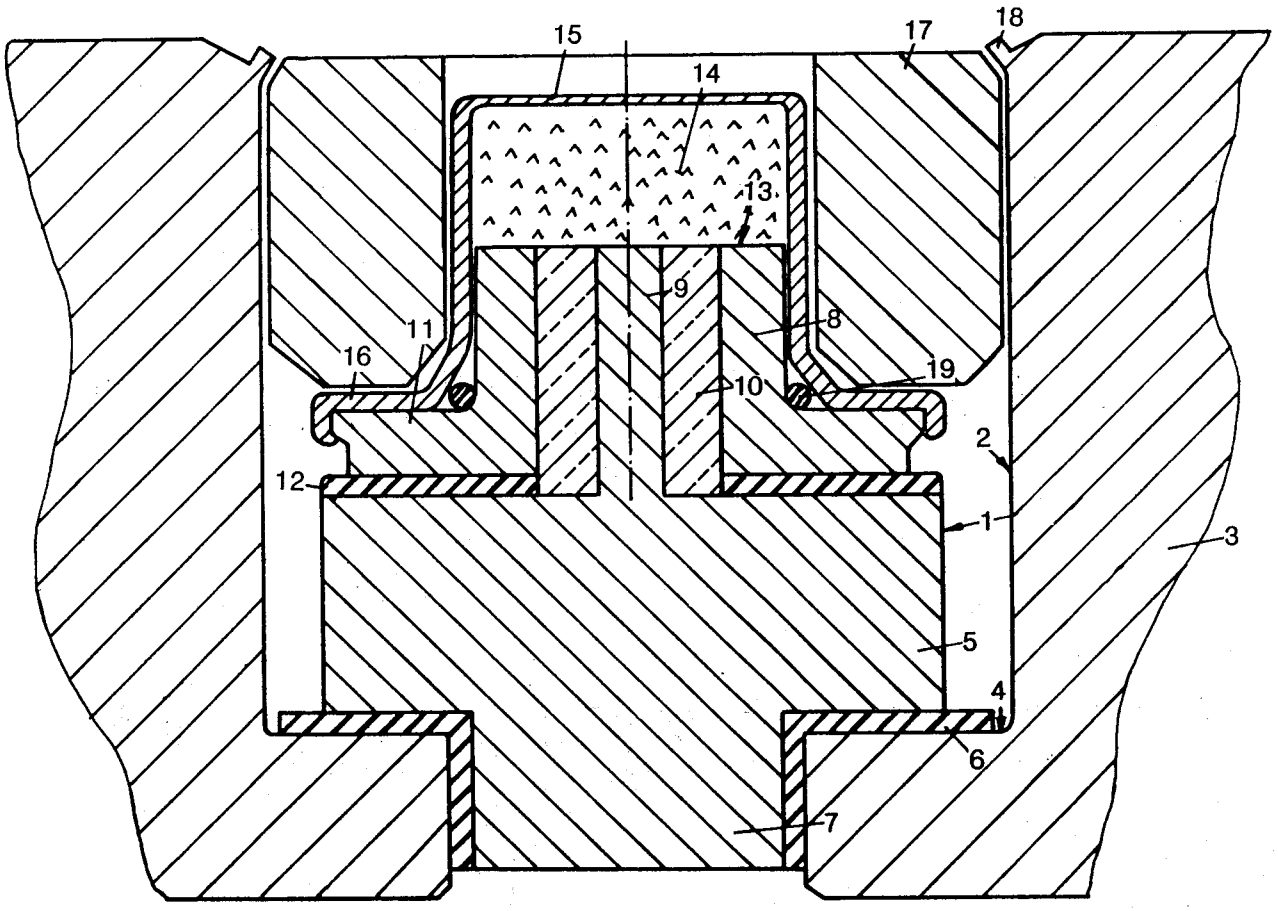
FIG. 1 is a vertical section through the electric igniter and FIG. 2 an enlarged vertical section of a part of the igniter.

FIG. 1 shows an electric igniter 1 mounted in an opening 2 of a wall 3 which encloses a change of an artillery projectile such as a shell or rocket. In order to retain the igniter in the wall when the projectile is subjected to high acceleration forces on firing, the opening is provided with a shoulder 4. The igniter itself comprises a broader part 5 which rests against the shoulder 4 via an isolating sleeve 6 which is capable of resisting the mechanical shock arising during the firing operation.

The broad part 5 of the igniter comprises a lower, narrower, portion 7 for connecting the igniter to a source of electrical power. Such means are known per se, however, and will therefore not be described here.

The electric igniter further comprises a first electrically conductive body 8 in the form of a cylindrical sleeve of e.g. stainless steel or other electrically conducting material. A second electrically conductive body 9 in the form of an elongate rod which extends coaxially inside the sleeve 8 is provided on the top portion of said broad part 5. Both this second body as well as the broad part 5 itself are made of an electrically conducting material, for instance an iron or nickel alloy. The bodies 8 and 9 are fixed relatively to each other by means of an electrically insulating body 10 of glass, porcelain or other similar material. The first body 8 is shaped at its lower end to form a flange 11 which, via an isolating ring 12, rests on the upper end surface of the broad part 5 of the igniter.

The first and second electrically conductive bodies 8 and 9 as well as the insulating body 10 are made with a common flat end surface 13 on which are arranged a number of layers which are not shown in detail in FIG. 1, but which are described below in connection with FIG. 2. A conventional pyrotechnical composition 14 is pressed onto the uppermost layer under high pressure. The composition is enclosed in a capsule 15 e.g. of aluminium, which is provided with a portion 16 which is bent over the flange 11 so that the pyrotechnical composition is maintained under high pressure against the end surface 13.

In order to retain the capsule 15 in position when subject to high retardation forces arising when ramming a round a ammunition, a mounting ring 17 is disposed in the opening 2 so as to force the portion 16 of the capsule firmly against the flange 11, thus maintaining the capsule in the correct position. The ring 17 is preferably made of stainless steel and is retained in the opening 2 by means of a deformation 18 on the wall 3 or by means of threading in the opening 2. In order to seal the pyrotechnical composition 14 against moisture, dust etc an O-ring 19 is disposed between the capsule 15 and the first body 8.

Figure 2:
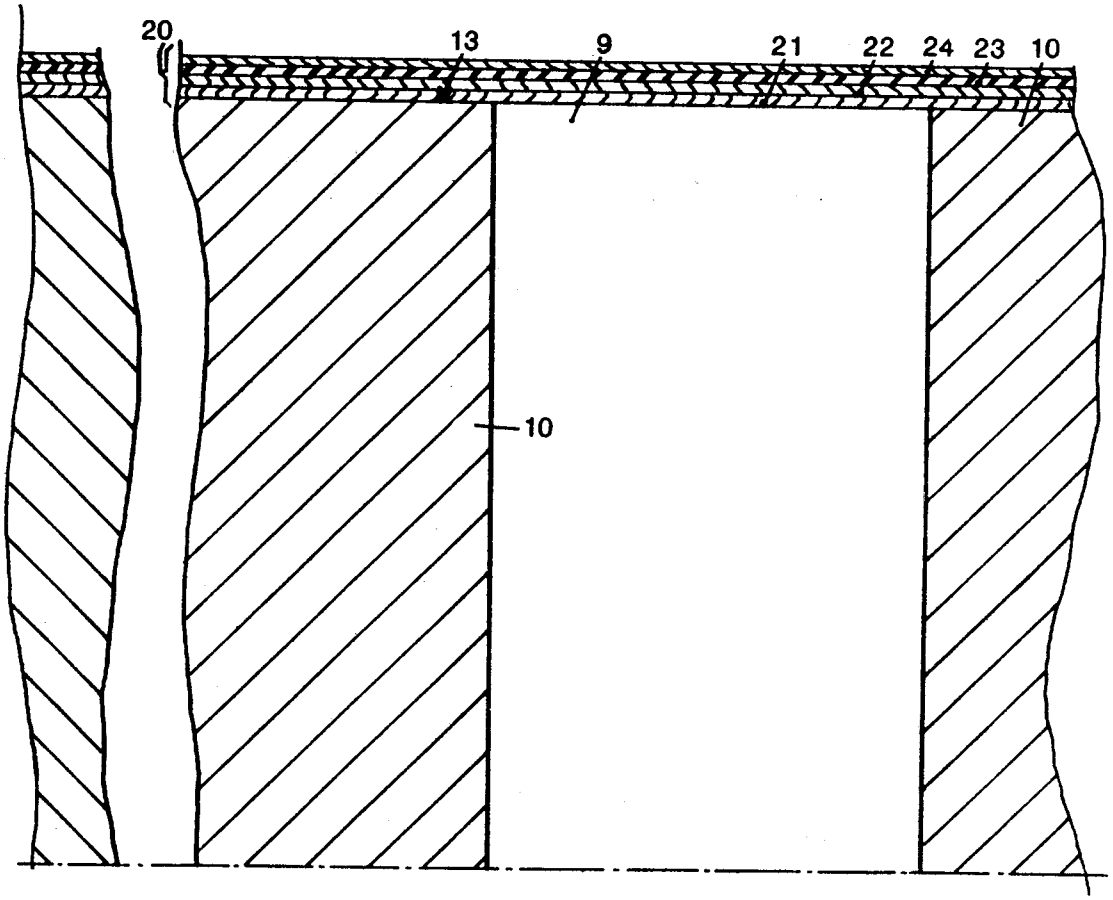

FIG. 2 shows in detail the interconnecting member 20 which electrically connects the bodies 8 and 9. The interconnecting member 20 comprises one or more comparatively thin metal layers 21, 22 which are bonded to the very smooth common end surface 13 of the bodies 8 and 9 and the insulating body 10. An additional layer 23 of inert material is disposed upon the metal layers 21, 22 in conformity with our co-pending Swedish Patent Application No. 79 07294-8 and its counterpart, U.S. Pat. No. 4,335,653.

In contrast to previous electric igniters in which the correct resistance value is determined by cutting gaps in the metal layers, such as gap referenced 24 in the abovementioned application, in the present case the layers provide an unbroken electrically conducting element. Instead of cutting gaps in one or more of the metal layers, at least the uppermost metal layer 22 is made of an oxidizable material to permit exact adjustment of its resistance by means of oxidation. One example of such an oxidizable material is tantalum, but aluminium can also be used.

By controlled oxidation of the upper metal layer 22 its resistance can be determined without the use of complicated laser cutting apparatus. It is very easy to obtain the correct resistance value just by controlling the oxidation time. After the tantalum layer has been oxidized the inert layer is then deposited to prevent aging and any additional unexpected oxidation of the tantalum layer. The unbroken upper metal layer 22 provides a better base for additional layers such as the inert layer 23 and especially for thin film layers.

Although the metal layers in FIG. 2 have been shown as unbroken, i.e. without any gaps, the resistance of the interconnecting member can be adjusted to a predetermined value by combining the two methods. Thus either or both layers 21 can be provided with gaps and the upper metal layer i.e. the tantalum layer oxidized. Even if a laser cutting apparatus is required to form the gaps, a more simple apparatus can be used as the accuracy with which the gaps are cut can be kept relatively low and the final adjustment of the resistance value can be obtained by means of oxidation of the tantalum layer 22.

As illustrated in FIG. 2 the interconnecting member 20 also comprises another layer 24 disposed upon the inert layer 23. As the entire upper surface of the layer is in contact with the pyrotechnic charge it is important that the layer is made of a metal which mechanically and chemically resists any influence by the powder of the pyrotechnic charge. The layer is therefore preferably made of gold or silver. The thickness of the layer is approximately 1 $\mu$M or less which means that the layer is preferably applied directly onto the inert layer by means of a vapourization under vacuum.

By using such an additional metal thin film layer a somewhat "slower" electrical function of the electrical igniter is obtained. The thin film layer functions as virtual earth and shields the igniter from electromagnetic radiation. The layer has also a good heat conducting ability which means that heat generated in the underlying metal layers due to electric interference pulses can more easily be led away. By varying the thickness of the inert layer as well as the thin film layer the thermal time constant of the electric igniter can be appropriately adjusted.

We claim:

1. An electric igniter for use with artillery ammunition; comprising two electrically conductive bodies, an electrically insulating body between said two bodies, the conductive bodies together with the insulating body defining a common end surface, an electrically conductive member disposed on said common end surface connecting the conductive bodies, and a pyrotechnic charge pressed into contact with said member and ignitable by heat generated in the member on flow of an electric current therethrough; said member being bonded to said common end surface and comprising at least one metal layer having a resistance value predetermined by oxidation of said layer; a layer of an inert material disposed directly on said one metal layer and a metal thin film layer disposed directly on the inert layer.

2. An electric igniter according to claim 1, in which said thin film layer comprises a material of high thermal conductivity and which withstands any influence from the pyrotechnic charge.

3. An electric igniter according to claim 2, in which the thickness of said metal thin film layer is no more than 1 $\mu$M.

4. An electric igniter according to claim 1, in which said metal layer is made of tantalum or aluminium.

5. An electric igniter according to claim 2 in which said thin film layer comprises gold or silver.

6. An electric igniter according to claim 1 in which said member having a resistance determined by oxidation comprises first and second metal layers, the first layer being bonded to said common end surface, and the second layer forming a metal oxidized layer deposited on said first metal layer.

* * * * *